US008991958B2

(12) United States Patent
Hiruma

(10) Patent No.: US 8,991,958 B2
(45) **Date of Patent: *Mar. 31, 2015**

(54) METHOD OF DRIVING LIQUID EJECTION HEAD AND DRIVE SIGNAL GENERATION DEVICE FOR LIQUID EJECTION HEAD

(71) Applicant: Seiko Epson Corporation, Tokyo (JP)

(72) Inventor: Kei Hiruma, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/163,112

(22) Filed: Jan. 24, 2014

(65) Prior Publication Data

US 2014/0139575 A1 May 22, 2014

Related U.S. Application Data

(63) Continuation of application No. 13/032,438, filed on Feb. 22, 2011, now Pat. No. 8,668,296.

(30) Foreign Application Priority Data

Feb. 22, 2010 (JP) ..... 2010-036448

(51) Int. Cl.
*B41J 29/38* (2006.01)
*B41J 2/045* (2006.01)

(52) U.S. Cl.
CPC ..... *B41J 2/04501* (2013.01); *B41J 2/04581* (2013.01); *B41J 2/04588* (2013.01)
USPC ..... 347/10; 347/9

(58) Field of Classification Search
CPC ..... B41J 2/04581; B41J 2/04588; B41J 2/04541; B41J 2/04593; B41J 2/0458
USPC ..... 347/10, 9
See application file for complete search history.

(56) References Cited

U.S. PATENT DOCUMENTS 6,502,914 B2 1/2003 Hosono et al.
6,705,696 B1 3/2004 Okuda et al.

(Continued)

FOREIGN PATENT DOCUMENTS

EP 0 900 657 3/1999
EP 1 034 928 9/2000

(Continued)

OTHER PUBLICATIONS

European Search report mailed May 19, 2011, cited in European Application No. 11155337.6.

(Continued)

*Primary Examiner* — Manish S Shah
*Assistant Examiner* — Yaovi Ameh
(74) *Attorney, Agent, or Firm* — Workman Nydegger

(57) ABSTRACT

A method of driving a liquid ejection head adapted to apply a voltage to the liquid ejection head to eject a liquid including a polymer is provided. The method includes raising the voltage from a first voltage to a second voltage; raising the voltage from the second voltage to a third voltage at a gradient larger than that in raising the voltage from the first to the second voltage, and then holding the voltage at the third voltage; dropping the voltage from the third voltage to a fourth voltage, and then holding the voltage at the fourth voltage; raising the voltage from the fourth voltage to a fifth voltage, and then holding the voltage at the fifth voltage; dropping the voltage from the fifth voltage to a sixth voltage, and then holding the voltage at the sixth voltage; and raising the voltage from the sixth voltage to a seventh voltage.

11 Claims, 6 Drawing Sheets

(56) References Cited

U.S. PATENT DOCUMENTS

| | | | | |
|---|---|---|---|---|
| 8,096,632 | B2 | 1/2012 | Ihara | |
| 8,668,296 | B2 * | 3/2014 | Hiruma | 347/10 |
| 2002/0167559 | A1 | 11/2002 | Hosono et al. | |
| 2003/0048331 | A1 | 3/2003 | Tomoaki et al. | |
| 2005/0054751 | A1 * | 3/2005 | Namba et al. | 523/160 |
| 2005/0126435 | A1 * | 6/2005 | Hanmura et al. | 106/31.46 |
| 2010/0188451 | A1 * | 7/2010 | Ozawa et al. | 347/10 |

FOREIGN PATENT DOCUMENTS

| | | |
|---|---|---|
| JP | 11-198444 | 7/1999 |
| JP | 2000-218778 | 8/2000 |
| JP | 2002-337333 | 11/2002 |
| JP | 2005-170035 | 6/2005 |

OTHER PUBLICATIONS

U.S. Appl. No. 13/032,438, Apr. 12, 2013, Office Action.
U.S. Appl. No. 13/032,438, Oct. 24, 2013, Notice of Allowance.

* cited by examiner

METHOD OF DRIVING LIQUID EJECTION HEAD AND DRIVE SIGNAL GENERATION DEVICE FOR LIQUID EJECTION HEAD

The present application is a Continuation of U.S. patent application Ser. No. 13/032,438, filed Feb. 22, 2011, which claims priority to Japanese Patent Application No. 2010-036448, filed Feb. 22, 2010, which applications are expressly incorporated herein by reference.

BACKGROUND OF THE INVENTION

1. Technical Field

Embodiments of the present invention relate to a method of driving a liquid ejection head and a drive signal generation device for a liquid ejection head.

2. Related Art

Conventional methods for manufacturing gel particles eject a liquid toward an ejection target liquid. Drug delivery systems have been considered where the gel particles manufactured by such a method as described above include a medicine. The gel particles are then injected into a blood vessel, thereby making the medicine reach an affected area in the body. In view of the injection of gel particles into the body, it is preferable to manufacture smaller gel particles. Therefore, it becomes necessary to make it possible to eject smaller droplets of the liquid from a liquid ejection head.

JP-A-2000-218778 discloses that in order to eject small droplets of a liquid, the variation time of a first voltage variation process for reducing the volume of a pressure generation chamber and the variation time of a second voltage variation process for expanding the volume of the pressure generation chamber in the driving waveform are set equal to or shorter than the natural period (the natural period of an actuator) of the natural vibration of an electromechanical transducer to thereby achieve the miniaturization.

However, as described above, miniaturizing and then ejecting the droplets of the liquid including a polymer continues to be problematic even if the variation time of the processes is set to be equal to or shorter than the natural period of the actuator as described above.

BRIEF SUMMARY OF THE INVENTION

An advantage of some aspects of an embodiment of the invention is to miniaturize and then eject droplets of a liquid including a polymer.

According to an aspect of an embodiment of the invention, a method of driving a liquid ejection head adapted to apply a voltage to the liquid ejection head to thereby eject a liquid including a polymer is provided. The method includes: raising the voltage from a first voltage to a second voltage, raising the voltage from the second voltage to a third voltage at a gradient larger than that in raising the voltage from the first voltage to the second voltage, and then holding the voltage at the third voltage, dropping the voltage from the third voltage to a fourth voltage, and then holding the voltage at the fourth voltage, raising the voltage from the fourth voltage to a fifth voltage, and then holding the voltage at the fifth voltage, dropping the voltage from the fifth voltage to a sixth voltage, and then holding the voltage at the sixth voltage, and raising the voltage from the sixth voltage to a seventh voltage.

Other aspects of embodiments of the invention will be apparent from the present specification and the accompanying drawings.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Figure 1:
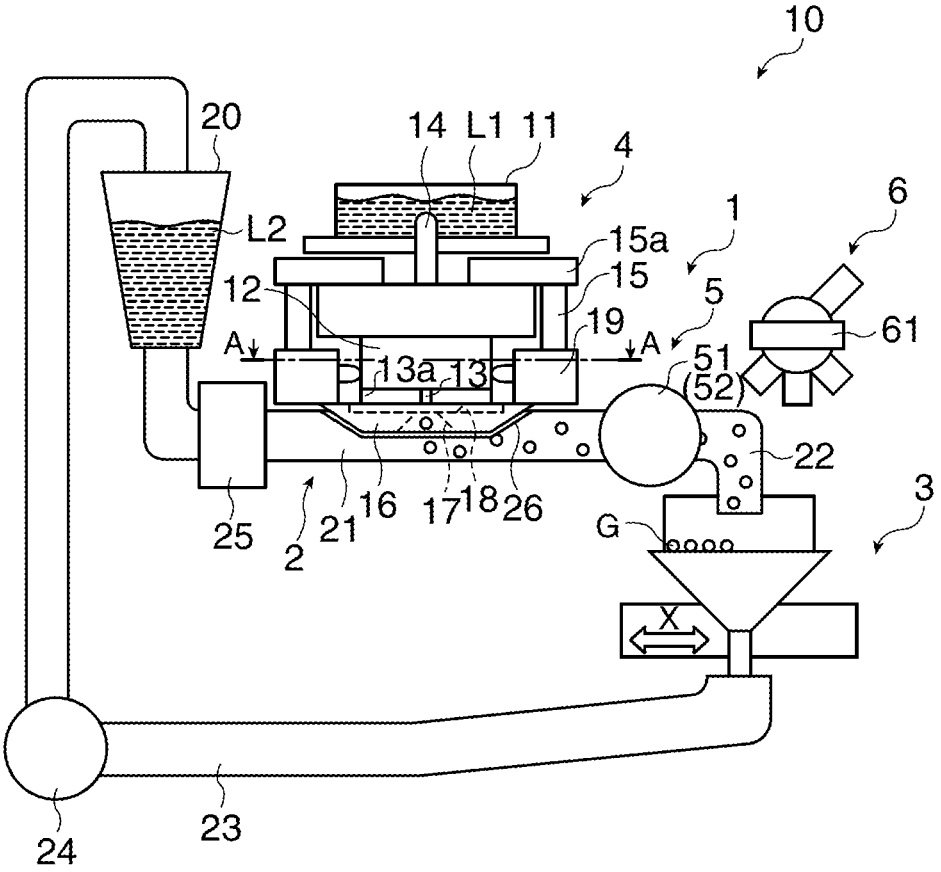
FIG. 1 is a schematic side view showing a gel manufacturing device.

According to the description of the present specification and the accompanying drawings, at least the following items become clear.

A method of driving a liquid ejection head adapted to apply a voltage to the liquid ejection head to thereby eject a liquid including a polymer is disclosed. The method includes: raising the voltage from a first voltage to a second voltage, raising the voltage from the second voltage to a third voltage at a gradient larger than that in raising the voltage from the first voltage to the second voltage, and then holding the voltage at the third voltage, dropping the voltage from the third voltage to a fourth voltage, and then holding the voltage at the fourth voltage, raising the voltage from the fourth voltage to a fifth voltage, and then holding the voltage at the fifth voltage, dropping the voltage from the fifth voltage to a sixth voltage, and then holding the voltage at the sixth voltage, and raising the voltage from the sixth voltage to a seventh voltage.

According to this configuration, the liquid, which includes a polymer, to be ejected can be miniaturized when ejecting the liquid including the polymer.

In one embodiment of the method of driving the liquid ejection head described above, the second voltage is one of equal to or higher than 50% of the third voltage.

According to this configuration, it becomes possible to provide a recessed section to a meniscus, thereby making it possible to eject further miniaturized droplets of the liquid.

In one embodiment of the method of driving the liquid ejection head described above, the gradient at which the voltage is dropped from the fifth voltage to the sixth voltage is gentler than the gradient at which the voltage is dropped from the third voltage to the fourth voltage.

According to this configuration, a tail protruding from the meniscus can appropriately be absorbed.

In one embodiment of the method of driving the liquid ejection head described above, the first voltage is equal to the seventh voltage.

According to this configuration, an intermediate voltage can be used as the first voltage and the seventh voltage.

In one embodiment of the method of driving the head described above, the fourth voltage is higher than the first voltage.

According to this configuration, it is possible to push the meniscus outward to the extent that a large droplet is not ejected.

In one embodiment of the method of driving the liquid ejection head described above, the viscosity of the liquid including the polymer is 5 cps or more.

According to this configuration, even the droplets of the liquid including the polymer with high viscosity can be miniaturized and ejected.

In one embodiment of the method of driving the liquid ejection head described above, the liquid including the polymer includes sodium alginate.

According to this configuration, the droplets of sodium alginate can be miniaturized and ejected.

A drive signal generation device for a liquid ejection head adapted to generate a drive signal for applying a voltage to a liquid ejection head and making the liquid ejection head eject a liquid including a polymer is provided. The drive signal generation device includes a section in which a voltage to be applied to the liquid ejection head is held at a first voltage, raised from the first voltage to a second voltage, raised from the second voltage to a third voltage at a gradient larger than the gradient in raising the voltage from the first voltage to the second voltage, and then held at the third voltage, dropped from the third voltage to a fourth voltage, and then held at the fourth voltage, raised from the fourth voltage to a fifth voltage, and then held at the fifth voltage, dropped from the fifth voltage to a sixth voltage, and then held at the sixth voltage, and raised from the sixth voltage to a seventh voltage.

According to this configuration, the droplets of a liquid including a polymer can be miniaturized and then ejected.

Embodiment

Figure 2:
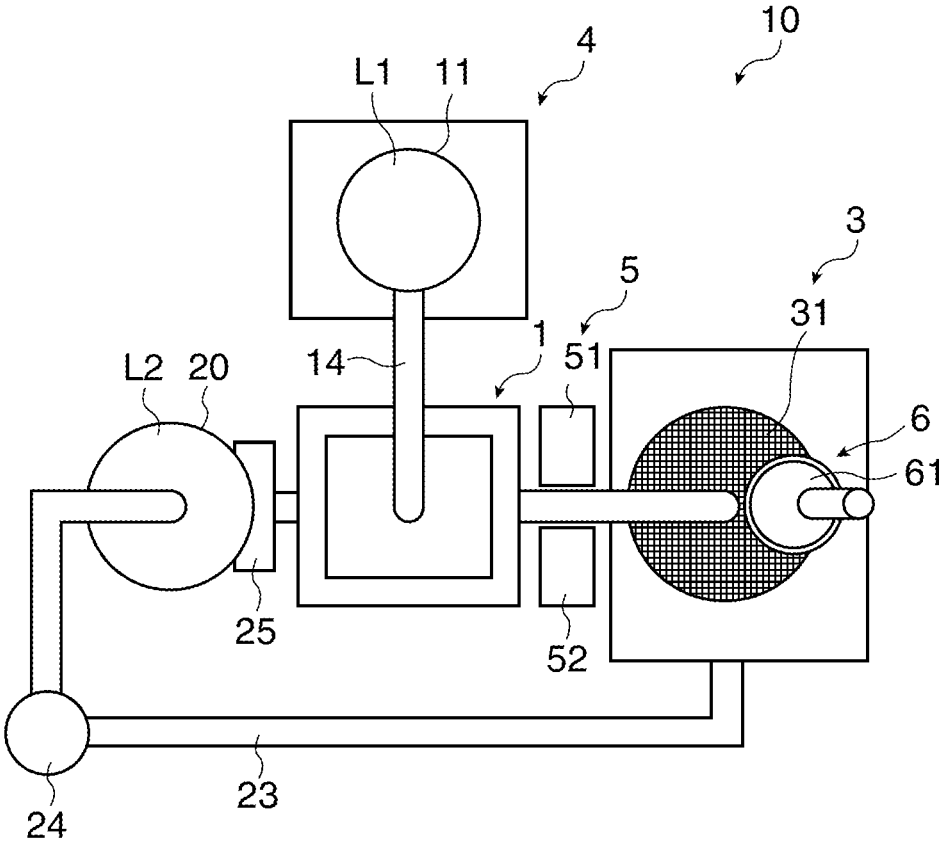
FIG. 2 is a schematic plan view showing the gel manufacturing device.

FIG. 1 is a schematic side view showing a gel manufacturing device, and FIG. 2 is a schematic plan view showing the gel manufacturing device. The gel manufacturing device 10 is provided with an ejection mechanism 1, a flow mechanism 2, a gel collection mechanism 3, an ejection measurement mechanism 4, a gel weighing mechanism 5, and an observation mechanism 6.

The gel manufacturing device 10 ejects a first solution L1 from the ejection mechanism 1 toward a second solution L2 flowing through the flow mechanism 2, thereby obtaining gel particles G generated from the first solution L1 and the second solution L2 reacting chemically with each other in a discharge section 22. In the present embodiment, sodium alginate solution is used as the first solution L1, and calcium chloride solution is used as the second solution L2. Sodium alginate and calcium chloride react chemically with each other to thereby generate sodium alginate gel.

The ejection mechanism 1 is provided with a first reservoir 11 for containing the first solution L1, an ejection head 12, a supply pipe 14 for supplying the first solution L1 from the first reservoir 11 to the ejection head 12, a gap plate 16, a reinforcing plate 19, fixing columns 15, and fixing jigs 15*a*.

The ejection head 12 has a nozzle plate 13*a* provided with a nozzle 13. The nozzle 13 has a diameter of, for example, 20 μm, and the first solution L1 is ejected from the nozzle 13 at an ejection frequency of not lower than 10 Hz in one embodiment. Although the condition of providing a single nozzle 13 to the ejection head 12 in the drawings, this is not a limitation, but it is also possible to form two or more nozzles 13. Although a single ejection head 12 is provided to the ejection mechanism 1 according to the drawings, this is not a limitation, but a configuration providing two or more ejection heads 12 to the ejection mechanism 1 can also be adopted.

The gap plate 16 is provided with a through hole 17 and a groove 18. The gap plate 16 is made, for example, of transparent acrylic resin. By using the transparent gap plate 16, the alignment between the nozzle 13 and the through hole 17 can easily be performed while checking it visually using a microscope and so on. The through hole 17 and the nozzle 13 are arranged so as to form a continuous hole. Thus, there is provided a configuration where the first solution L1 that is ejected from the nozzle 13 passes through the through hole 17.

The through hole 17 is provided with a water-repellent coating such as fluorine series or silicon series. Similarly, the gap plate 16 is provided with a water-repellent coating such as fluorine series or silicon series. The diameter of the through hole 17 on the side facing the nozzle 13 is equivalent to or larger than the diameter of the nozzle 13 in one embodiment. Further, the diameter of the through hole 17 on the other side is equivalent to or larger than the diameter of the through hole 17 on the side facing the nozzle 13 in one embodiment. In other words, the through hole 17 may have a tapered shape with a diameter increasing in a direction from the side facing the nozzle 13 to the other side. The angle of the tapered shape can be arbitrarily determined within a range from 90 degrees to 180 degrees. The flow section 21 side of the through hole 17 is worked or configured to have a round shape.

The gap plate 16 is fixed to the reinforcing plate 19 formed to have a frame shape with an adhesive or the like. The reinforcing plate 19 reinforces the mechanical strength of the gap plate 16. The gap plate 16 and the reinforcing plate 19 are formed to have outer diameters decreasing in a direction from the reinforcing plate 19 to the gap plate 16.

The flow mechanism 2 is provided with a second reservoir 20 for containing the second solution L2, the flow section 21 and the discharge section 22 through which the second solution L2 flows, and a solution circulation section 23. The second reservoir 20 communicates with a filter 25 and the flow section 21. The discharge section 22 communicates with the flow section 21. The second solution L2 contained in the second reservoir 20 is filtrated by the filter 25, and then fed to the flow section 21 and the discharge section 22. The discharge section 22 transmits the second solution L2 having flowed through the flow section 21 and the gel particles G are thus generated. The solution circulation section 23 is provided with, for example, a pump 24. The second solution L2 having passed through the discharge section 22 is collected by the solution circulation section 23, and then circulated by the pump 24 to the second reservoir 20.

The second reservoir 20 is made of, for example, transparent or translucent polyethylene. The flow section 21 and the discharge section 22 are made of, for example, transparent acrylic resin, and are each formed to have a tubular shape in one embodiment. The discharge section 22 is formed to have an L shape, and is arranged so that the second solution L2 flowing from the flow section 21 does not fly in all directions from the discharge section 22.

Since negative pressure is caused inside the through hole 17 of the gap plate 16 when the second solution L2 flows between the flow section 21 and the gap plate 16, flow of the air (gas) from the groove 18 to the through hole 17 is caused. Thus, it is possible to prevent the second solution L2 from flowing from the flow mechanism 2 into the through hole 17 of the gap plate 16. As a result, it is possible to maintain or help the ejection velocity of the first solution L1 ejected from the nozzle 13 of the ejection head 12.

Since the flow section 21 side of the through hole 17 is worked or configured to have a round shape in the ejection mechanism 1, the second solution L2 is prevented from flowing from the through hole 17 of the gap plate 16 into the nozzle 13 of the ejection head 12 to thereby prevent the nozzle 13 from being choked with the second solution L2.

The solution circulation section 23 collects the second solution L2, which has flowed through the flow section 21, the discharge section 22, and a gel collection mechanism 3 described later. The solution circulation section 23 and circulates the second solution L2 to the second reservoir 20.

The gel collection mechanism 3 collects the gel particles G generated by ejecting the first solution L1 to the second solution L2 thus flowing in the flow section 21.

The ejection measurement mechanism 4 measures the weight of the first reservoir 11 of the ejection mechanism 1. By measuring the weight of the first reservoir 11 for containing the first solution L1, the weight of the first solution L1 ejected from the nozzle 13 is measured using the difference in weight between before and after the ejection.

The gel weighing mechanism 5 is provided with a laser source 51 and a photoelectrical detector 52. The projection light projected from the laser source 51 is applied to the flow section 21 through which the second solution L2 and the gel particles G flow. In the flow section 21, by receiving the reflected light, which is obtained by reflecting the projection light, by the photoelectrical detector 52, the number, the shape, and the size of the gel particles G thus generated are measured.

The observation mechanism 6 observes or measures the condition of the gel particles G collected by the gel collection mechanism 3, such as the shape or the size. The observation mechanism 6 is provided with a camera 61. By shooting the gel particles G captured by a collection net 31 using the camera 61, the condition of the gel particles G thus generated, such as the shape or the size is observed or measured.

Figure 3:
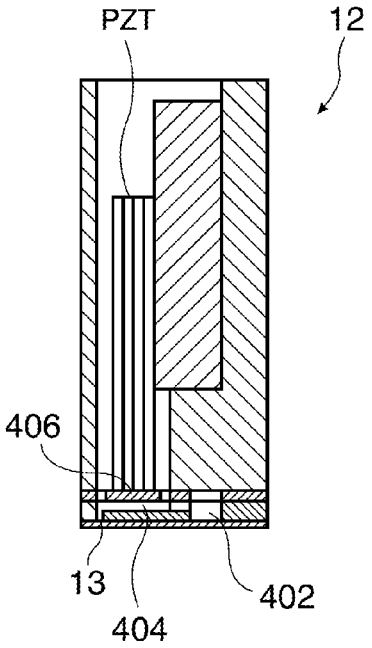
FIG. 3 is a diagram for illustrating a structure of an ejection head.

FIG. 3 is a diagram for explaining the structure of the ejection head 12. The drawing shows a nozzle 13, a piezoelectric element PZT, a liquid supply channel 402, a nozzle communication channel 404, and an elastic plate 406.

The liquid supply channel 402 is supplied with a high viscosity liquid from the first reservoir 11. Such a liquid or the like is supplied to the nozzle communication channel 404. A drive signal described later is applied to the piezoelectric element PZT. When the drive signal is applied, the piezoelectric element PZT expands or contracts with the drive signal to thereby vibrate the elastic plate 406. Thus, the liquid is moved so as to correspond to the amplitude of the drive signal.

The movement of the liquid described above will specifically be explained. The piezoelectric element PZT of the present embodiment has a characteristic of contracting in a vertical direction of FIG. 3 in response to application of a voltage. When a higher voltage is applied as a drive signal instead of a certain voltage, the piezoelectric element PZT contracts in the vertical direction of FIG. 3 to thereby deform the elastic plate 406 in a direction of increasing the capacity of the nozzle communication channel 404. On this occasion, the liquid surface (the meniscus described later) in the nozzle 13 moves inward (upward in FIG. 3) in the nozzle 13. To the contrary, when a lower voltage is applied instead of a certain voltage, the piezoelectric element PZT expands in the vertical direction of FIG. 3 to thereby deform the elastic plate 406 in a direction of reducing the capacity of the nozzle communication channel 404. On this occasion, the liquid surface in the nozzle 13 moves outward (downward in FIG. 3) in the nozzle 13.

Figure 4:
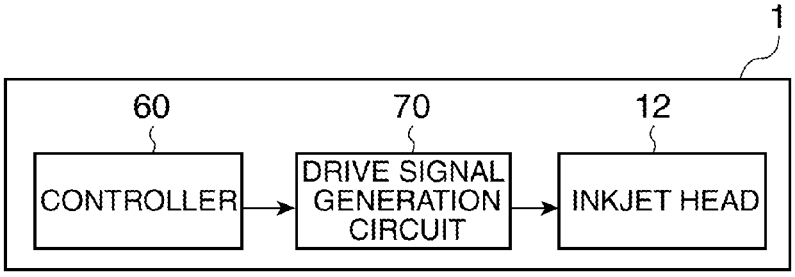
FIG. 4 is a block diagram of an ejection mechanism according to an embodiment of the invention.

FIG. 4 is a block diagram of the ejection mechanism 1 according to the present embodiment of the invention. The ejection mechanism 1 is provided with a controller 60 for controlling the ejection mechanism 1 and the gel manufacturing device 10, a drive signal generation circuit 70 for generating the drive signal, and the ejection head 12. The controller 60 transmits waveform data of the drive signal to be formed to the drive signal generation circuit 70. The drive signal generation circuit 70 generates the drive signal based on the waveform data thus transmitted. The drive signal thus generated is applied to the piezoelectric element PZT of the ejection head 12, and thus the ejection head 12 ejects a droplet.

Figure 5:
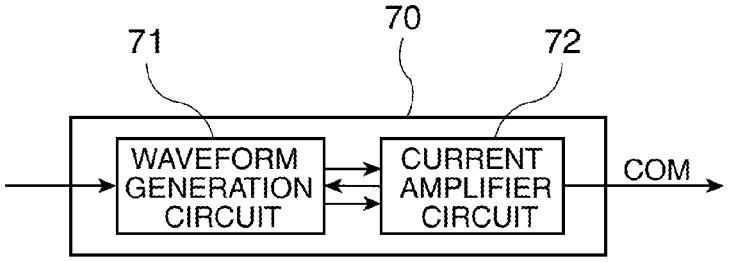
FIG. 5 is a block diagram for illustrating a configuration of a drive signal generation circuit.

FIG. 5 is a block diagram for illustrating a configuration of the drive signal generation circuit 70. The drive signal generation circuit 70 of the present embodiment has a waveform generation circuit 71 and a current amplifier circuit 72.

Figure 6:
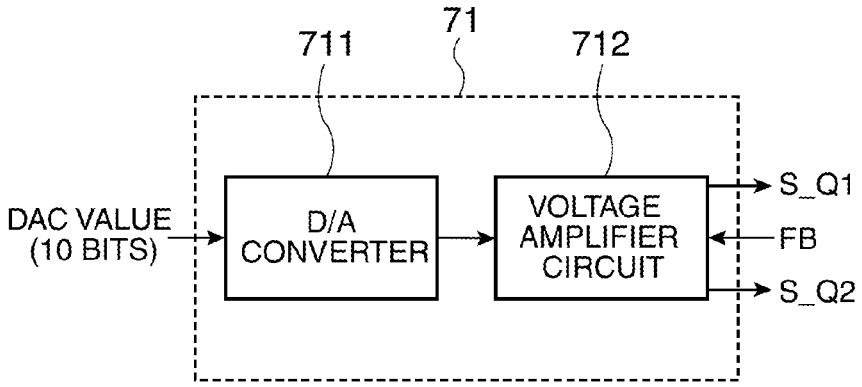
FIG. 6 is a block diagram for illustrating a configuration of a waveform generation circuit.

FIG. 6 is a block diagram for illustrating a configuration of the waveform generation circuit 71. The waveform generation circuit 71 has a D/A converter 711 and a voltage amplifier circuit 712. The D/A converter 711 is an electrical circuit for outputting a voltage signal corresponding to a DAC value. The DAC value is information for indicating the voltage (hereinafter also referred to as an output voltage) to be output from the voltage amplifier circuit 712, and is transmitted from the controller 60 based on the waveform data stored therein.

The voltage amplifier circuit 712 amplifies the output voltage from the D/A converter 711 up to the voltage appropriate to the operation of the piezoelectric element PZT. The voltage amplifier circuit 712 of the present embodiment amplifies the output voltage from the D/A converter 711 up to maximum of 40-odd volts. The output voltage thus amplified is output to the current amplifier circuit 72 as a control signal S_Q1 and a control signal S_Q2.

Figure 7:
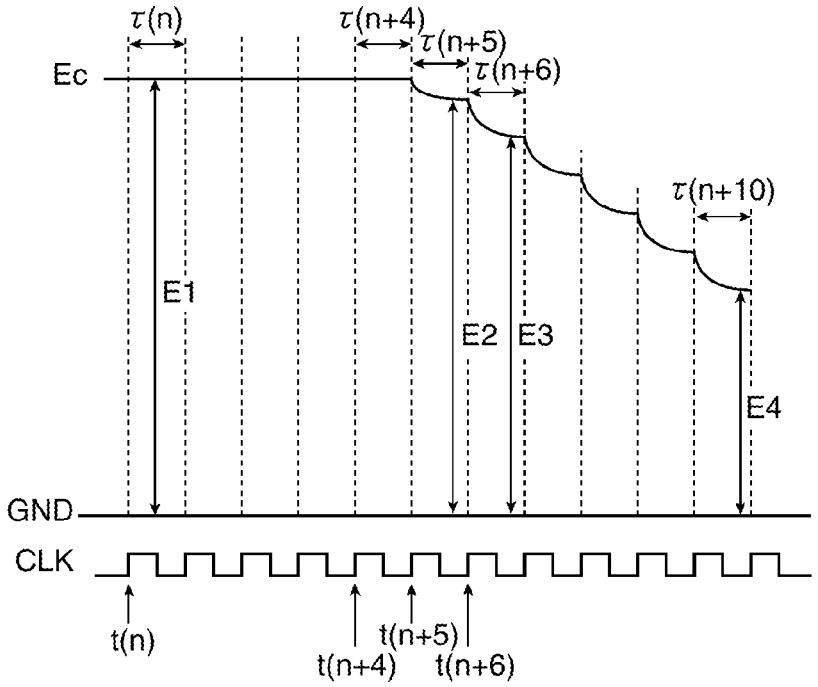
FIG. 7 is a diagram for illustrating an operation of dropping an output voltage of a current amplifier circuit from a voltage E1 to a voltage E4.

FIG. 7 is a diagram for illustrating an operation of dropping the output voltage of the current amplifier circuit 72 from a voltage E1 to a voltage E4.

When generating the drive signal COM, the controller 60 outputs the DAC value every predetermined updating period $\tau$ sequentially to the D/A converter 711. In the example shown in FIG. 7, the DAC value corresponding to the voltage E1 is output at the timing t(n) defined by a clock CLK. Thus, the voltage amplifier circuit 712 outputs the voltage E1 in the period $\tau(n)$. Up to the updating period $\tau(n+4)$, the DAC value corresponding to the voltage E1 is repeatedly input to the D/A converter 711 from the controller 60, and the voltage amplifier circuit 712 continuously outputs the voltage E1. At the timing t(n+5), the DAC value corresponding to the voltage E2 is input to the D/A converter 711 from the controller 60. Thus, the output of the voltage amplifier circuit 712 is dropped from the voltage E1 to the voltage E2 in the period $\tau(n+5)$.

Similarly, at the timing t(n+6), the DAC value corresponding to the voltage E3 is input to the D/A converter 711 from the controller 60, thus the output of the voltage amplifier circuit 712 is dropped from the voltage E2 to the voltage E3. Since the DAC values are sequentially input to the D/A converter 711 in a similar manner as described above, the voltage output from the voltage amplifier circuit 712 is dropped gradually. The output of the voltage amplifier circuit 712 is dropped to the voltage E4 in the period $\tau(n+10)$. In the manner as described above, the drive signal is output from the waveform generation circuit 71.

Figure 8:
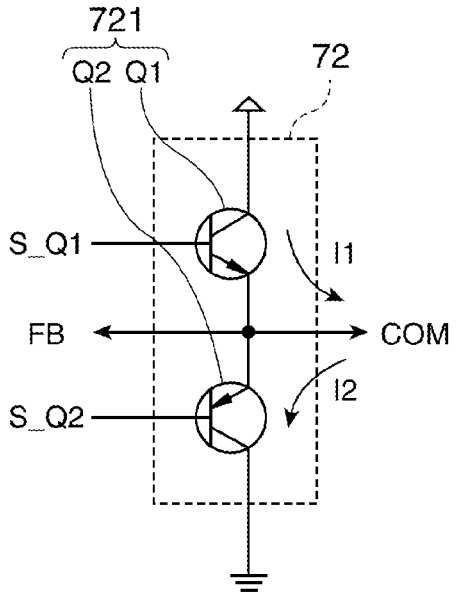
FIG. 8 is a diagram for illustrating a configuration of the current amplifier circuit.

FIG. 8 is a diagram for illustrating a configuration of the current amplifier circuit 72. The current amplifier circuit 72 has a pair of transistors 721 for power-amplifying the drive signal COM. The pair of transistors 721 has a NPN transistor Q1 and a PNP transistor Q2 having the respective emitter terminals connected to each other. The NPN transistor Q1 is a transistor acting when the voltage of the drive signal COM rises. The NPN transistor Q1 has a collector connected to the power supply and an emitter connected to an output signal line of the drive signal COM. The PNP transistor Q2 is a transistor acting when the voltage thereof drops. The PNP transistor Q2 has a collector connected to the ground (earth) and an emitter connected to an output signal line of the drive signal COM. The voltage (the voltage of the drive signal COM) of a node where the respective emitters of the NPN transistor Q1 and the PNP transistor Q2 are connected to each other is fed back to the voltage amplifier circuit 712A as indicated by the reference symbol FB.

The operation of the current amplifier circuit 72 is controlled by the output voltage from the waveform generation circuit 71. For example, if the output voltage is in the rising state, the NPN transistor Q1 is set to the ON state by the control signal S_Q1. In conjunction therewith, the voltage of the drive signal COM also rises. In contrast, if the output voltage is in the falling state, the PNP transistor Q2 is set to the ON state by the control signal S_Q2. In conjunction therewith, the voltage of the drive signal COM also drops. In the case in which the output voltage is constant, both of the NPN transistor Q1 and the PNP transistor Q2 are set in the OFF state. As a result, the drive signal COM becomes a constant voltage.

Therefore, the drive signal having a desired shape can be generated.

Figure 9:
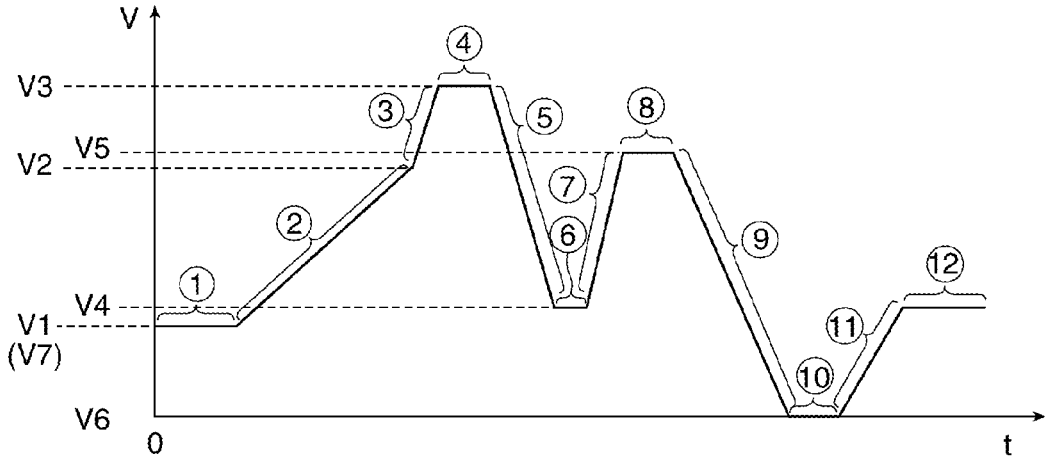
FIG. 9 is an illustrative diagram of a drive signal in the present embodiment.
Figure 10:
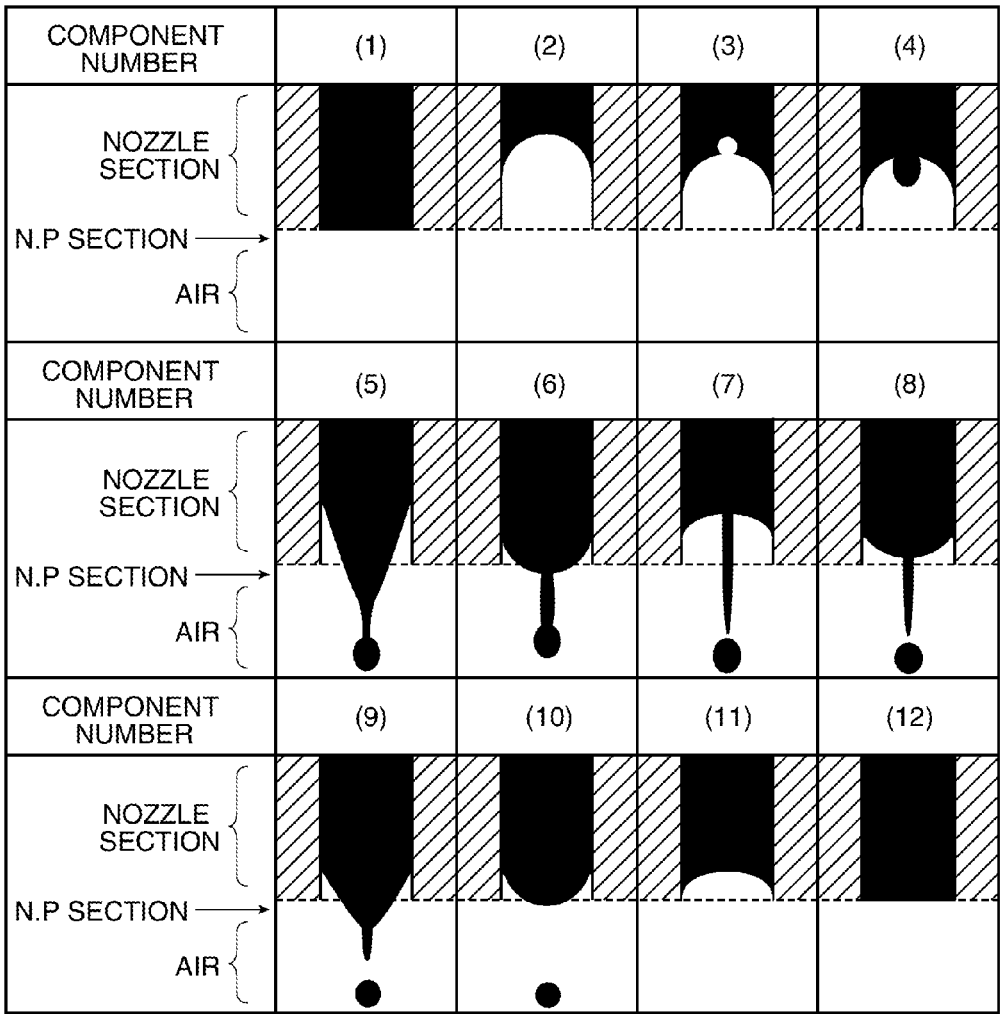
FIG. 10 is a diagram for illustrating the movement of a meniscus in the present embodiment.

FIG. 9 is an explanatory diagram of the drive signal in the present embodiment. The drawing shows the variation in the voltage of the drive signal with respect to the time t. FIG. 10 is a diagram for illustrating the movement of the meniscus in the present embodiment. Here, the "meniscus" is a liquid surface in the nozzle. Both drawings show component numbers. The component numbers in FIG. 9 are each surrounded by a circle. the same component numbers are surrounded by parenthesis in FIG. 10 FIG. 9 shows the voltages corresponding to the component numbers, and FIG. 10 shows conditions of the nozzle section corresponding to the component numbers. In the drawing, the liquid parts are filled with a black color. It should be noted that the "N.P section" in the drawing denotes a nozzle plate section. Thus, the conditions of the meniscus corresponding to the voltage variation can be recognized.

In the component number 1, the voltage is held at an intermediate voltage of V1 (corresponding to a first voltage). The intermediate voltage denotes a constant voltage to be applied to the piezoelectric element PZT in the case of providing no particular change to the meniscus. On this occasion, the meniscus does not change, and therefore, forms a plane substantially coplanar with the nozzle plate.

In the component number 2, the voltage is raised from the intermediate voltage V1 to a voltage V2 (corresponding to a second voltage). Since the voltage applied to the piezoelectric element PZT rises, the meniscus is pulled inward into the ejection head. Since the voltage variation is relatively gentle, the meniscus has a shape of a gentle arc.

In the component number 3, the voltage is raised from the voltage V2 to a voltage V3 (corresponding to a third voltage). In the component number 3, the uprise or rise of the voltage is steeper than in the case of the component number 2 corresponding to the voltage V2. In other words, the rising rate of the voltage in the component number 3 is higher than the rising rate of the voltage in the case of the component number 2. Since the meniscus is pulled in more rapidly toward the head by raising the voltage steeper as described above, a small hollow shown in the drawing is formed at the center portion of the meniscus. It should be noted that the voltage V2 is equal to or higher than 50% of the voltage V3 in one embodiment.

In the component number 4, the voltage is held at the voltage V3. Since there exists the period during which the voltage is held at the voltage V3, the balance of the surface tension of the small hollow formed in the component number 3 is broken down, and the hollow moves downward in the drawing so as to be restored. Due to the restoring force described above, a droplet expands downward to form a fine droplet.

In the component number 5, the voltage is dropped from the voltage V3 to a voltage V4 (corresponding to a fourth voltage). On this occasion, the voltage V4 is set to be lower than the voltage V2. Although it is conceivable that the fine droplet is ejected from the nozzle even in the state of the component number 4 described above, in order for promoting the ejection of the droplet, the voltage is dropped in the component number 5. Due to the drop of the voltage, the whole droplet is pushed out of the nozzle. It should be noted that the voltage V4 may be higher than the voltage V1 described above.

In the component number 6, the voltage is held at the voltage V4. Here, it functions as a buffer prior to applying the voltage variation in the opposite direction in the subsequent component to hold the voltage at the constant voltage V4.

In the component number 7, the voltage is raised from the voltage V4 to a voltage V5 (corresponding to a fifth voltage). By raising the voltage from the voltage V4 to the voltage V5 as described above to thereby pull the meniscus inward into the head, the fine droplet and the meniscus are separated from each other.

In the component number 8, the voltage is held at the voltage V5. Thus, the motion of the meniscus is settled. The voltage V5 is set to be lower than the voltage V3, and higher than the voltage V2. Here, although the motion of the meniscus is settled, it can be observed that a tail is generated between the fine droplet and the meniscus.

In the component number 9, the voltage is dropped from the voltage V5 to a voltage V6 (0V, corresponding to a sixth voltage). By thus dropping the voltage as described above, the meniscus is projected to the outside (the lower side of FIGS. 3 and 10) of the nozzle plate to thereby collect the tail observed in the component number 8. It should be noted that the gradient at which the voltage is dropped from the voltage V5 to the voltage V6 is gentler than the gradient at which the voltage is dropped from the voltage V3 to the voltage V4. In other words, the variation rate of the voltage from the voltage V5 to the voltage V6 is lower than the variation rate in the case of dropping the voltage from the voltage V3 to the voltage V4.

In the component number 10, the voltage is held at the voltage V6. Thus, the motion of the meniscus is settled.

In the component number 11, the voltage is raised from the voltage V6 to an intermediate voltage V7 (corresponding to a seventh voltage). In the component number 12, the state of the intermediate voltage V7 is held to thereby prepare for the subsequent droplet ejection.

According to the process described above, it becomes possible to provide the small hollow to the surface of the meniscus and to eject the finer droplet using the hollow formed in the meniscus. In particular, according to the present embodiment, it is possible to eject a high viscosity liquid having viscosity equal to or higher than 5 cps. For example, the viscosity of sodium alginate to be ejected in the present embodiment is in a range of 5 through 20 cps. The surface tension of sodium alginate is about 70 mN/m.

It should be noted that although it is assumed in the present embodiment that sodium alginate is ejected, the liquid is not limited thereto, but a liquid including a polymer and having high viscosity can be ejected. Here, the polymer denotes those having 1,000 or more atoms, and a molecular weight is ten thousand or more.

Although in the present embodiment the piezoelectric element contracting in the vertical direction in FIG. 3 in response to application of the voltage is used, it is also possible to use a piezoelectric element expanding in the vertical direction in FIG. 3 in response to application of the voltage. The drive signal waveform in this case becomes the signal having a magnitude correlation of the voltage value opposite to that of the drive signal shown in the present embodiment.

Inside the gel particles manufactured in the present embodiment, a desired material can be encapsulated.

Various types of cells and various types of medical substances can be cited as an example of the desired material to be encapsulated inside the gel particles, but the desired material is not limited thereto. Examples of cells include, but are not limited to, vessel endothelial cells, fibroblast cells, smooth muscle cells, red blood cells, white blood cells, blood platelets, cancer cells, and bacteria (single cells) such as bacteria coliform and lactic acid bacteria. The gel particles encapsulating these cells can be used as protection from various types of barrier stimulus of the cells such as desiccation, carriers of cells and bacteria, therapeutic equipment such as cell transportation gels, and diagnostic instruments such as biochips. Examples of the medical substances that can be encapsulated in the gel particles include, but are not limited to, antibiotics, antifungals, vessel endothelial cell growth factors, basic fibroblast growth factors, hepatocellular growth factors, various types of vasoactive materials, antiallergic agents, antihistamine agents, hormonal agents such as insulin, protein substances, enzymes, nucleic acids, sugar groups, amino acids, emulsified fats, moisturizing agents, perfume materials and dyes. The gel particles encapsulating such medical substances can be used as a drug delivery system (DDS) for such medical substances. By encapsulating the medical substances in the gel particles, various advantages can be obtained compared to the case of directly administering the medical substances, such as keeping the duration of activity longer, controlling the duration of activity, buffering impacts of the environment on the medical substances, making it possible to mix a number of medical substances without reacting with each other. As microparticles with smaller sizes, for example, nanoparticles of metal, inorganic materials, or organic materials can also be included. Since pigments, fluorescent particles, liposomes, nanomicelles, or the like are themselves provided with a particular function, micro-gel beads including them can be used as the DDS with a further complicated release control function. By encapsulating catalysts or enzymes in the micro-gel beads, micro-sized reaction fields of the catalysts or the enzymes are provided. Application in microcolumn in reaction fields in microchannel becomes possible.

Although the explanation is presented here assuming that the sodium alginate solution is used as the first solution L1 and the calcium chloride solution is used as the second solution, the solutions are not limited thereto. These materials are cited as an example of a combination of an alginate solution and an alkaline earth metal salt solution, and barium chloride can also be cited as an example of the alkaline earth metal salt.

For example, as the combination of the first solution L1 and the second solution L2, there can be cited combinations of (1) a boric acid solution and a polyvinyl alcohol solution, (2) a peptide hydrogel-forming peptide solution and a sodium chloride solution, (3) a thermogelling thermoreversible hydrogel-forming hydrophilic polymer solution and warm water. Combinations of (4) a water solution including any two components of a thrombin solution, a fibrinogen solution, and a calcium salt solution and a water solution including the rest of one component can also be adopted.

As peptide hydrogel-forming peptide of the combination (2) described above, there can be cited the peptide having neutral amino acid, acidic amino acid, and/or basic amino acid arranged alternately, and the number of amino acids of 12 through 20, preferably about 16.

The thermogelling thermoreversible hydrogel-forming hydrophilic polymer of the combination (3) described above is block copolymer composed of a temperature-sensitive polymer segment such as poly(N-isopropylacrylamide) or polypropylene oxide, and a hydrophilic polymer segment such as polyethylene oxide, and is a material commercially available from Mebiol Inc. under a trade name of "Mebiol Gel," for example. Since Mebiol Gel (the trade name) is a sol at a low temperature, and is gelled at 37° C. or higher, by using Mebiol Gel (the trade name) solution at 36° C. or lower as the first solution L1 and warm water at 37° C. or higher as the second solution L2, the first solution L1 emitted to the second solution L2 is gelled in the second solution L2. Mebiol Gel (the trade name) solution has a relatively high viscosity, but can appropriately be ejected in the case of using the drive signal according to the embodiment.

Other Embodiments

Although in the embodiment described above the gel manufacturing device 10 is illustrated as the liquid ejection device, the liquid ejection device is not limited thereto, but can also be embodied as a liquid discharge device for ejecting or discharging other fluids (a liquid, a liquid-like body having particles of a functional material dispersed, or a flowable body such as a gel). Similar technologies to the embodiment described above can be applied to various kinds of devices using the inkjet technology such as a color filter manufacturing device, a dyeing device, a fine processing device, a semiconductor manufacturing device, a surface processing device, a three-dimensional modeling device, a liquid vaporizing device, an organic EL manufacturing device (in particular, a polymer EL manufacturing device), a display manufacturing device, a deposition device, or a DNA chip manufacturing device. Methods therefor and manufacturing methods can also be included in a range of applications.

The embodiments described above are for making understanding of the invention easier, but not for providing limited interpretations of the invention. The invention can obviously be modified or improved within the scope and spirit thereof, and include equivalents thereof.

What is claimed is:

1. A method of driving a liquid ejection head in order to eject a liquid including a polymer, the method comprising:

applying a voltage to the liquid ejection head;

raising the voltage from a first voltage to a third voltage, wherein at a second voltage between the first voltage and the third voltage, a gradient at which the voltage is raised changes to a larger gradient, wherein the value of the second voltage is closer to the value of the third voltage than to the value of the first voltage; and holding the voltage at the third voltage.

2. The method according to claim 1, wherein the viscosity of the liquid including the polymer is 5 cps or more.

3. The method according to claim 1, wherein the liquid including the polymer includes sodium alginate.

4. A method of driving a liquid ejection head in order to eject a liquid including a polymer, the method comprising:

applying a voltage to the liquid ejection head;

dropping the voltage from a first voltage to a third voltage, wherein at a second voltage between the first voltage and the third voltage, a gradient at which the voltage is dropped changes to a larger magnitude of a gradient; and holding the voltage at the third voltage.

5. The method according to claim 4, wherein the second voltage is one of equal to and lower than 50% of the third voltage.

6. The method according to claim 5, further comprising:

raising the voltage from the third voltage to a fourth voltage, and then holding the voltage at the fourth voltage;

dropping the voltage from the fourth voltage to a fifth voltage, and then holding the voltage at the fifth voltage;

raising the voltage from the fifth voltage to a sixth voltage, and then holding the voltage at the sixth voltage; and dropping the voltage from the sixth voltage to a seventh voltage.

7. A drive signal generation device for a liquid ejection head adapted to generate a drive signal for applying a voltage to a liquid ejection head and making the liquid ejection head eject a liquid including a polymer, the drive signal generation device comprising a section in which a voltage to be applied to the head is held at a first voltage, wherein the section raises the first voltage to a third voltage, wherein at a second voltage between the first voltage and the third voltage, a gradient at which the voltage is raised changes to a larger gradient, wherein the value of the second voltage is closer to the value of the third voltage than to the value of the first voltage, wherein the voltage is then held at the third voltage.

8. The drive signal generation device according to claim 7, wherein the section is configured to raise the voltage from the third voltage to a fourth voltage, and then hold the voltage at the fourth voltage, drop the voltage from the fourth voltage to a fifth voltage, and then hold the voltage at the fifth voltage, raise from the fifth voltage to a sixth voltage, and then hold the voltage at the sixth voltage, and drop the voltage from the sixth voltage to a seventh voltage.

9. A drive signal generation device for a liquid ejection head adapted to generate a drive signal for applying a voltage to a liquid ejection head and making the liquid ejection head eject a liquid including a polymer, the drive signal generation device comprising a section in which a voltage to be applied to the head is held at a first voltage, wherein the section drops the first voltage to a third voltage, wherein at a second voltage between the first voltage and the third voltage, a gradient at which the voltage is dropped changes to a larger magnitude of a gradient, wherein the voltage is then held at the third voltage.

10. The drive signal generation device according to claim 9, wherein the second voltage is one of equal to and lower than 50% of the third voltage.

11. The drive signal generation device according to claim 9, wherein the section is configured to raise the voltage from the third voltage to a fourth voltage, and then hold the voltage at the fourth voltage, drop the voltage from the fourth voltage to a fifth voltage, and then hold the voltage at the fifth voltage, raise from the fifth voltage to a sixth voltage, and then hold the voltage at the sixth voltage, and drop the voltage from the sixth voltage to a seventh voltage.

* * * * *